US007562726B2

(12) United States Patent
Tibussek et al.

(10) Patent No.: US 7,562,726 B2
(45) Date of Patent: Jul. 21, 2009

(54) DEVICE FOR DRILLING A BORE IN THE GROUND

(75) Inventors: Fritz Tibussek, Mönchengladbach (DE); Peter Heinrichs, Wegberg (DE)

(73) Assignee: Wirth Maschinen- und Bohrgeräte-Fabrik GmbH, Erkelenz (DE)

( * ) Notice: Subject to any disclaimer, the term of this patent is extended or adjusted under 35 U.S.C. 154(b) by 91 days.

(21) Appl. No.: 10/556,495

(22) PCT Filed: May 7, 2004

(86) PCT No.: PCT/EP2004/004899

§ 371 (c)(1),
(2), (4) Date: Jul. 31, 2006

(87) PCT Pub. No.: WO2004/101947

PCT Pub. Date: Nov. 25, 2004

(65) Prior Publication Data

US 2008/0047758 A1 Feb. 28, 2008

(30) Foreign Application Priority Data

May 13, 2003 (DE) ..... 103 21 617

(51) Int. Cl.
*E21B 10/00* (2006.01)
*E21B 4/16* (2006.01)

(52) U.S. Cl. ..... 175/343; 175/348

(58) Field of Classification Search ..... 175/343, 175/348; 299/85.1, 71, 781
See application file for complete search history.

(56) References Cited

U.S. PATENT DOCUMENTS 6,102,139 A * 8/2000 Tibussek et al. ..... 175/296

FOREIGN PATENT DOCUMENTS

| | | |
|---|---|---|
| DE | 2 162 023 | 11/1972 |
| DE | 3416514 | 11/1985 |
| DE | 43 32 113 | 3/1995 |
| DE | 197 49 409 | 5/1999 |
| DE | 101 32 753 | 3/2002 |
| RU | 134 644 | 3/1960 |
| WO | 97/34070 | 9/1997 |

* cited by examiner

*Primary Examiner*—Giovanna C Wright
(74) *Attorney, Agent, or Firm*—Friedrich Kueffner

(57) ABSTRACT

The invention relates to a device for drilling a bore in the ground, comprising a drive system with a connecting rod assembly that extends from the drive system into the ground. The end of said assembly pointing towards the face or base of the bore is connected to a tool head (40). The device also comprises several tools (41) that are located on the tool head (40) and work on the face or the base of the bore. The inventive device is characterised in that each tool (41) comprises an excavation disc (45) and elements that cause the excavation disc (45) to oscillate during operation.

18 Claims, 9 Drawing Sheets

DEVICE FOR DRILLING A BORE IN THE GROUND

BACKGROUND OF THE INVENTION

The invention relates to a device for drilling a bore in the ground.

A device of this type is disclosed by WO 97/34070. The percussive tools are in this case connected directly in a plurality to the tool head, so the percussive energy is transferred via the drive medium to the tools sunk in the bore and from said tools directly to the base of the bore, so that the connecting rod assembly remains largely unaffected thereby. The tool head is connected via the connecting rod assembly to a drive device, normally arranged outside the bore and having a rotary drive, so that the tools arranged on the tool head operate at points on the base of the bore which are always new. The devices mentioned are mostly used to operate in solid rock.

In practice, this type of drilling is of increasing importance since, firstly, the quality of the bores is better and the direction of the bores can be maintained virtually exactly; secondly, because of the sound-absorbing method of use in the bore without any substantial external effect, environmental criteria such as noise nuisance are satisfied considerably better.

In installations of this type, transporting the rock material separated and excavated away at the face or the base of the bore out of the bore can be carried out within the hollow connecting rod assembly in the manner of what is known as "reverse circulation". For instance, the air lift method can be used for this purpose, in which air as a flushing medium is blown into the drilling assembly above the tool head, so that the air rising in the connecting rod assembly produces a pressure difference in the connecting rod assembly between bore and surface, which induces a flow velocity in the connecting rod assembly, with which the rock material is driven out through the connecting rod assembly.

In the case of the known device, percussive hammers are used as tools. Although, by using this device, satisfactory drilling progress is achieved, in particular in hard rock, it is disadvantageous that the drilling efficiency decreases, in particular in softer strata.

SUMMARY OF THE INVENTION

The invention is therefore based on the object of providing a device which ensures satisfactory drilling progress in an extremely wide range of rock formations.

This object is achieved by the invention in that each of the tools comprises an excavation disk and means which set the excavation disk oscillating in operation means that each tool simultaneously exerts on the face or the base of the bore a percussive action which loosens hard rock and also an excavating action which carries away loosened hard rock and softer soil formations. Different rock formations can thus be loosened and carried away efficiently with the device according to the invention.

Pins or disk rollers, in particular, can be used as removal means.

Particularly preferred is an embodiment of the device according to the invention in which at least one drive device is provided, by means of which the tool head can be set rotating about the bore longitudinal axis. The drive device can both be arranged outside the bore and the torques can be transmitted via the connecting rod assembly. However, it is likewise possible to mount the connecting rod assembly nonrotatably and to provide the drive device in or on the tool head. The rotational movement of the tool head ensures that the excavation disks operate at different points on the face or the base of the bore.

The drive device for the tool head can be equipped in such a way that the rotation takes place in a fixed direction of rotation, that is to say either in or counter to the clockwise direction.

However, it is likewise possible to configure the drive device in such a way that the rotation takes place in alternating directions of rotation, for example through rotational angles between 90° and 270°. This embodiment has the advantage that it is possible to dispense with complicated rotary leadthrough seals, such as would be necessary in order to supply fluid media to the tool head, or wiping contact arrangements such as would be necessary in order to introduce electric currents, for example in order to drive the tools. The seal and wiping contact arrangements can be replaced by simple flexible lines which are not susceptible to faults.

In a particularly preferred embodiment of the device according to the invention, means are provided which set the excavation disk of each tool rotating during the operation of the device. This measure intensifies the excavation action on the rock to be loosened, the drilling efficiency increases. The means are, for example, hydraulic, pneumatic or electric rotary drives.

Trials have shown that the drilling efficiency is particularly high if the rotational frequency of the excavation disk of each tool is lower than its oscillation frequency. The ratio between rotational frequency and oscillation frequency is preferably 1:30 to 1:60.

In a particularly preferred refinement of the device according to the invention, each tool comprises a rotationally driven main shaft which has a shaft journal whose axis forms an acute angle with the axis of the main shaft, and a head carrying the excavation disk, which is mounted such that it can rotate about the axis of the shaft journal and has a circumferential region which runs on an opposing circumferential region. As a result of this measure, the excavation disk is set in oscillation movement by the main shaft at a frequency which corresponds to the rotational frequency of the main shaft. As a result of the circumferential region of the head running on the opposing circumferential region, the rotation of the main shaft simultaneously sets the excavation disk into a rotation whose rotational frequency depends on the configurations of the circumferential region and of the opposing circumferential region. A fixed relation between oscillation and rotational frequency of the excavation disk can therefore be predefined by design.

However, in order to be able to adapt the device according to the invention optimally to different rock formations, it is particularly desirable to be able to vary the ratio of oscillation to rotation. In the particularly preferred embodiment of the device, this is made possible by the opposing circumferential region itself being capable of being set rotating. Depending on the direction of rotation of the opposing circumferential region, with a constant rotational speed of the main shaft, an increase or reduction in the resultant rotational speed of the excavation disk is thus effected.

The opposing circumferential region and the circumferential region running on it can be configured in any way which ensures the running action during operation. Because of the simplicity of production and the operational reliability, however, it is preferred for the circumferential region to have external toothing and for the opposing circumferential region to have internal toothing.

The opposing circumferential region is preferably formed by a hollow gear which is arranged concentrically with respect to the main shaft axis and which, according to the particularly preferred embodiment of the invention, can be set rotating.

It has been shown that the ratio of the oscillation frequency and the rotational frequency which can be achieved with a nonrotatable opposing circumferential region is not optimal for a large number of applications. Normally, a speed of the drill head with a lower ratio would be more advantageous for the drilling progress. A preferred embodiment of the device according to the invention therefore provides for the opposing circumferential region to be set rotating by means of an epicyclic gear mechanism which is in engagement with the main shaft. This embodiment has the advantage that it requires no further drive motors.

However, it is likewise possible to set the opposing circumferential region rotating by means of a separate drive, independently of the main shaft, that is to say not to couple the opposing circumferential region and main shaft. The separate drive is particularly preferably configured such that it can be controlled or regulated, which means that, during operation, adaptation of the ratio between the drill head rotational speed and oscillation frequency to the type of rock occurring in each case is possible.

BRIEF DESCRIPTION OF THE DRAWING

Exemplary embodiments of the device according to the invention are illustrated in the drawing, in which.

DETAILED DESCRIPTION OF THE INVENTION

Figure 1:
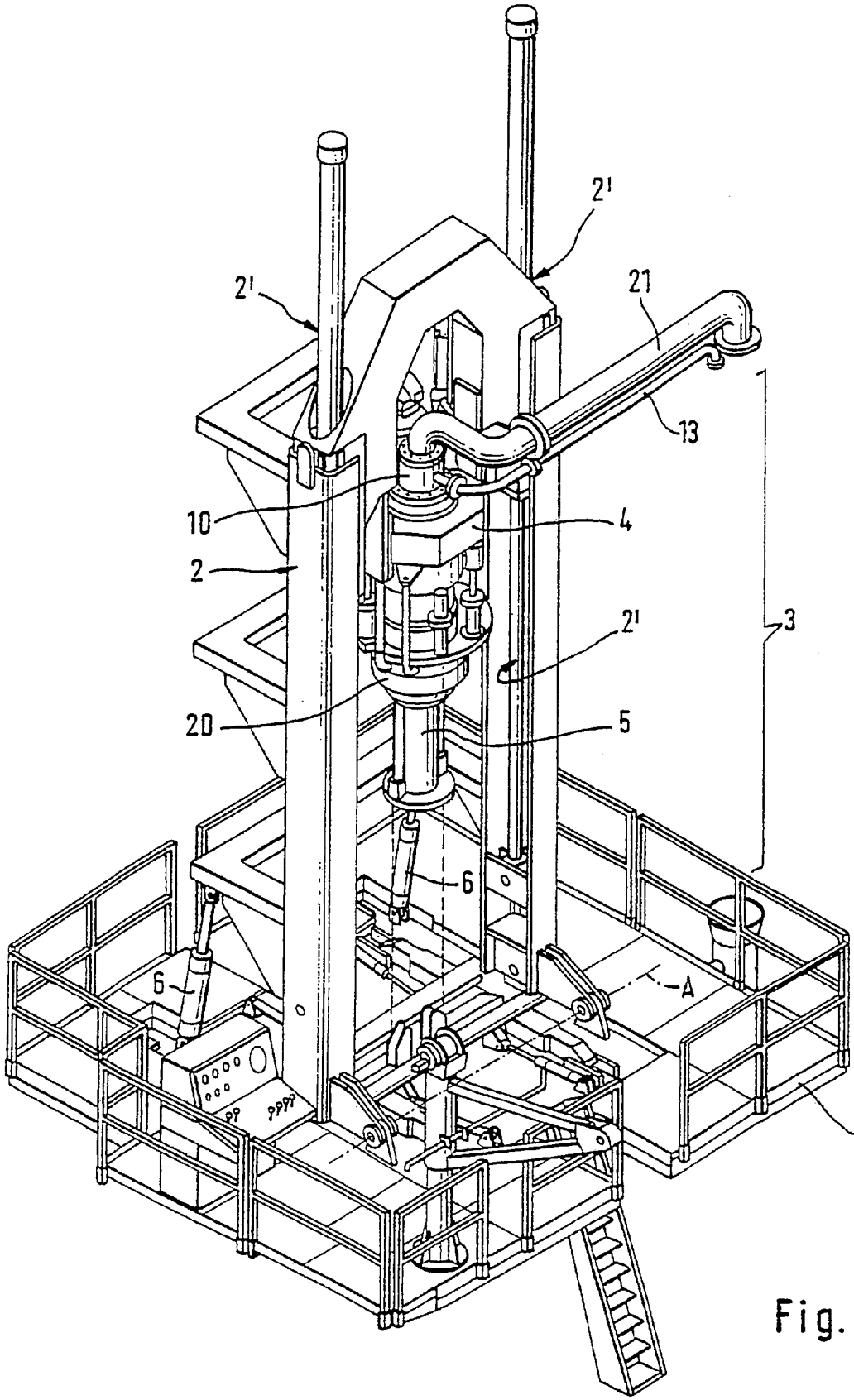
FIG. 1 shows, in perspective form, a first embodiment of a drive system of a device according to the invention.

FIG. 1 shows a first embodiment of a part of a device according to the invention which is arranged outside a bore to be drilled in the ground. The drive system of the device, designated overall by 3, is fixed to a supporting device 2 which is supported on a working platform designated overall by 1. A rotary drive head 4, shown schematically, acts on a connecting rod assembly 5 having segments that can be connected to one another, of which only the upper part is shown and which extends (indicated only dashed) through the working platform 1 into the bore to be drilled in the ground and as far as the tool head. The drive of the connecting rod assembly 5 having the rotary drive head 4 can be carried out in a conventional manner known from the prior art, for example via a hydraulic motor.

Figure 1A:
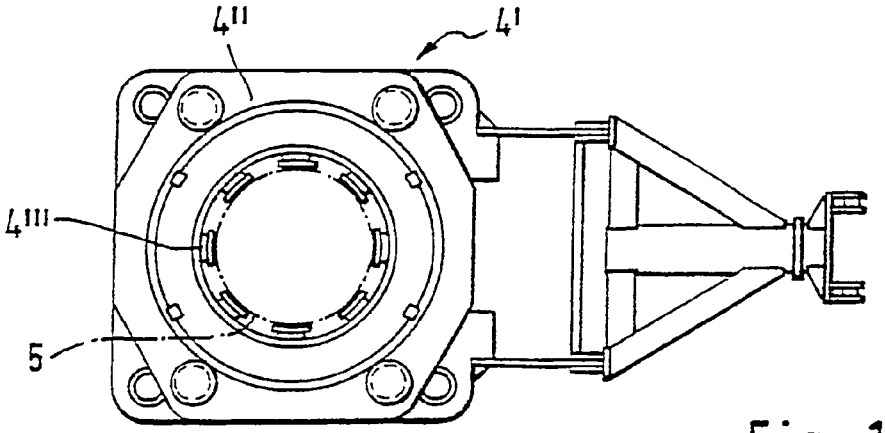
FIG. 1*a* shows a rotary drive which, in the embodiment of the drive unit according to FIG. 1, can be used as alternative to the rotary drive illustrated herein.

Alternatively, however, it is likewise possible, instead of the rotary drive head 4 arranged at the upper end of the connecting rod assembly 5, to use a rotary drive 4' illustrated in FIG. 1*a*, such as is known in design terms per se from piping devices.

This rotary drive 4' comprises a stationary, outer part 4", opposite which an annular inner part 4'", whose internal diameter is matched to the external diameter of the connecting rod assembly 5 and can optionally be connected to the latter, at least in the drive direction, in an operative connection, that is to say by a force fit or form fit, can be driven in rotation. The drive can be carried out, for example, by a hydraulic motor. With its stationary part 4", the rotary drive 4' can be operatively connected to variable-length force generators 2', such as spindles or piston/cylinder units, provided on the supporting device 2. If the connecting rod assembly 5 and the inner part 4'" of the rotary drive 4' are configured in such a way that a force-transmitting connection between the connecting rod assembly 5 and the inner part 4'" can also be achieved in the longitudinal direction of the former, then a forward drive force can also be introduced into the connecting rod assembly via the rotary drive 4'. However, it is likewise possible to mount the rotary drive 4' on the supporting device so as to be fixed and to configure the inner part 4'" and connecting rod assembly 5 in such a way that the connecting rod assembly 5 can be displaced in the inner part 4'" in its longitudinal direction. In this case, the forward drive forces have to be introduced into the connecting rod assembly, for example, by acting on the first rotary connecting head 10, yet to be described.

Arranged at the upper end of the connecting rod assembly 5 is a first rotary connecting head, designated by 10, via which the material loosened at the base of the bore in the ground is carried away to the outside via an outlet pipe 21 and compressed air is introduced into the connecting rod assembly by means of a first feed line 13. Arranged under the first rotary connecting head 10 is a second rotary connecting head, designated overall by 20. The supporting device 2 can be swiveled about a horizontal axis A and is connected to swiveling drives 6, so that it can be inclined and it is also possible for bores in the ground to be drilled in a manner deviating from the vertical.

Figure 2:
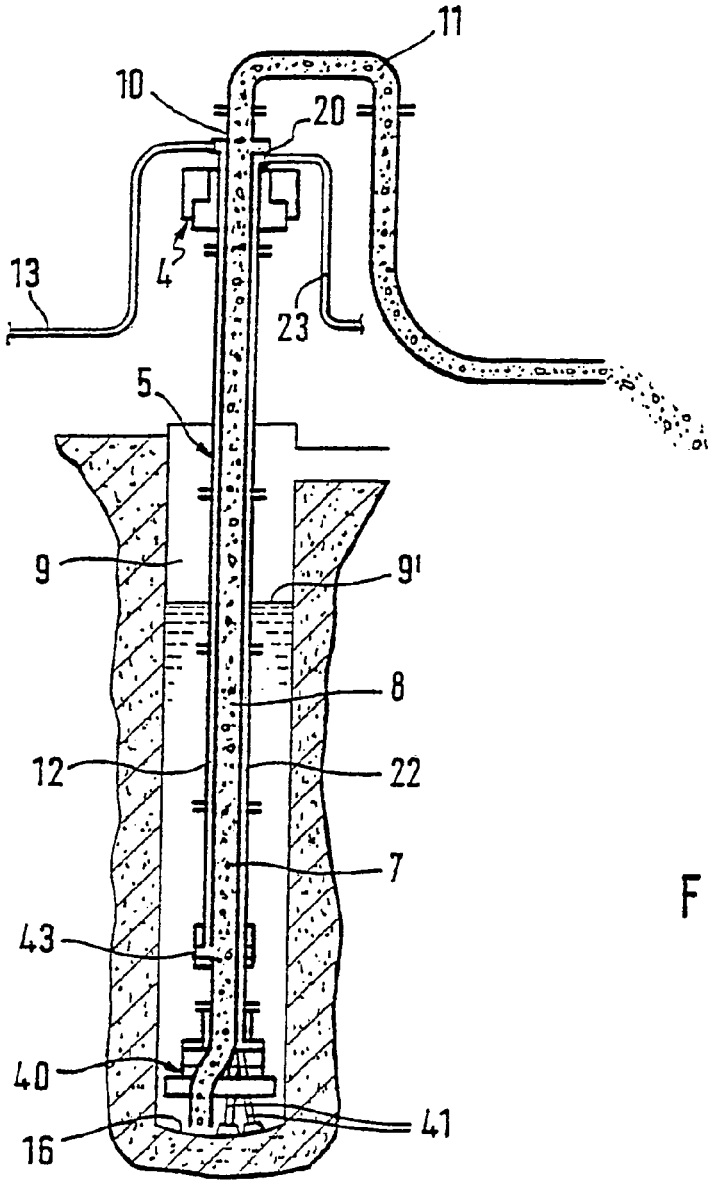
FIG. 2 shows, in schematic form, the action of the air lift system in a device according to the invention.

FIG. 2 explains in schematic terms the method by which the drilled material loosened by tools 41 of a tool head 40 is conveyed outward from the base 16 of the bore 9 in the ground, partially filled with water, for example as far as a level 9'. The interior of the connecting rod assembly 5 forms a flushing pipe 8, which is normally filled with water, into which air is blown in above the tool head 40 through an inlet valve 43, having been compressed outside the drilling apparatus by a compressor, not shown, and is led downward along the connecting rod assembly 5 by means of a first feed 12 via a first feed line 13 on the first rotary connecting head 10. The air blown in effects an upward flow within the flushing pipe 8 as a result of the difference in density between the liquid interspersed with air bubbles in the flushing pipe 8 and the external liquid in the bore 9 in the ground, with which upward flow the drilled material 7 is transported upward and flushed out of the device via the outlet pipe 11. Via a second feed line 23 in the second connecting head 20 of the second feed 22, shown in one piece with the first connecting head, the operating medium is supplied and, via the latter, is led downward along the connecting rod assembly 5 in order to drive the tools 41 of the tool head 40. The operating medium used can be hydraulic fluid under pressure. However, it is likewise possible to configure the drive for the tools electrically. Instead of the second connecting head, a wiping contact arrangement can then be used in order to feed the electrical energy in.

Figure 3:
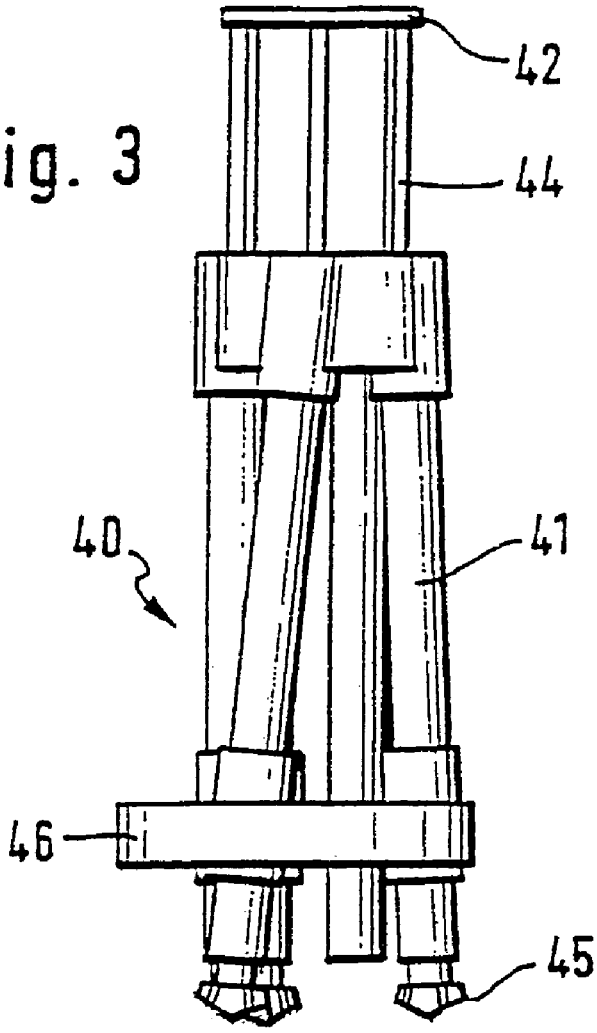
FIG. 3 shows, schematically, a side view of a tool head having a plurality of tools.
Figure 4:
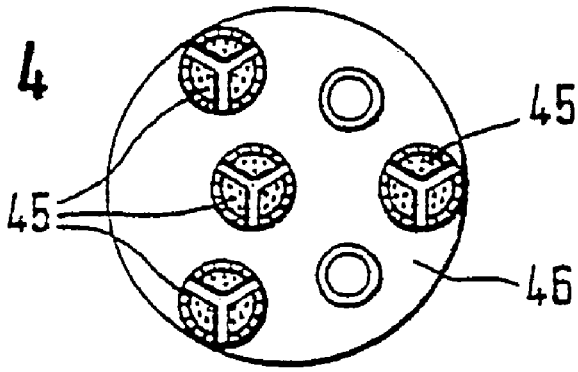
FIG. 4 shows a view according to FIG. 3 from below.

In FIGS. 3 and 4, a tool head 40, which is provided for a hydraulic drive, for example, is shown schematically. The tools 41 driven by the hydraulic medium are connected via supports 44 to a mounting plate 42, which is fitted to the lower end of the connecting rod assembly 5. The excavation disks 45 arranged on the tools 41 act downward on the base 10 of the bore 9 in the ground and fragment the rock there. The respective point of action moves onward in the circumferential direction as a result of the rotation of the tool head. By fitting the tools 41 at different radii, it is possible to sweep over the entire bore cross section. The number and arrangement of the tools 41 can be matched to the diameter of the bore 9 in the ground and the material to be removed. At their lower ends, the tools 41 are held and guided on a guide plate 46 shaped like a circular disk with a diameter corresponding to the diameter of the bore in the ground.

Figure 5:
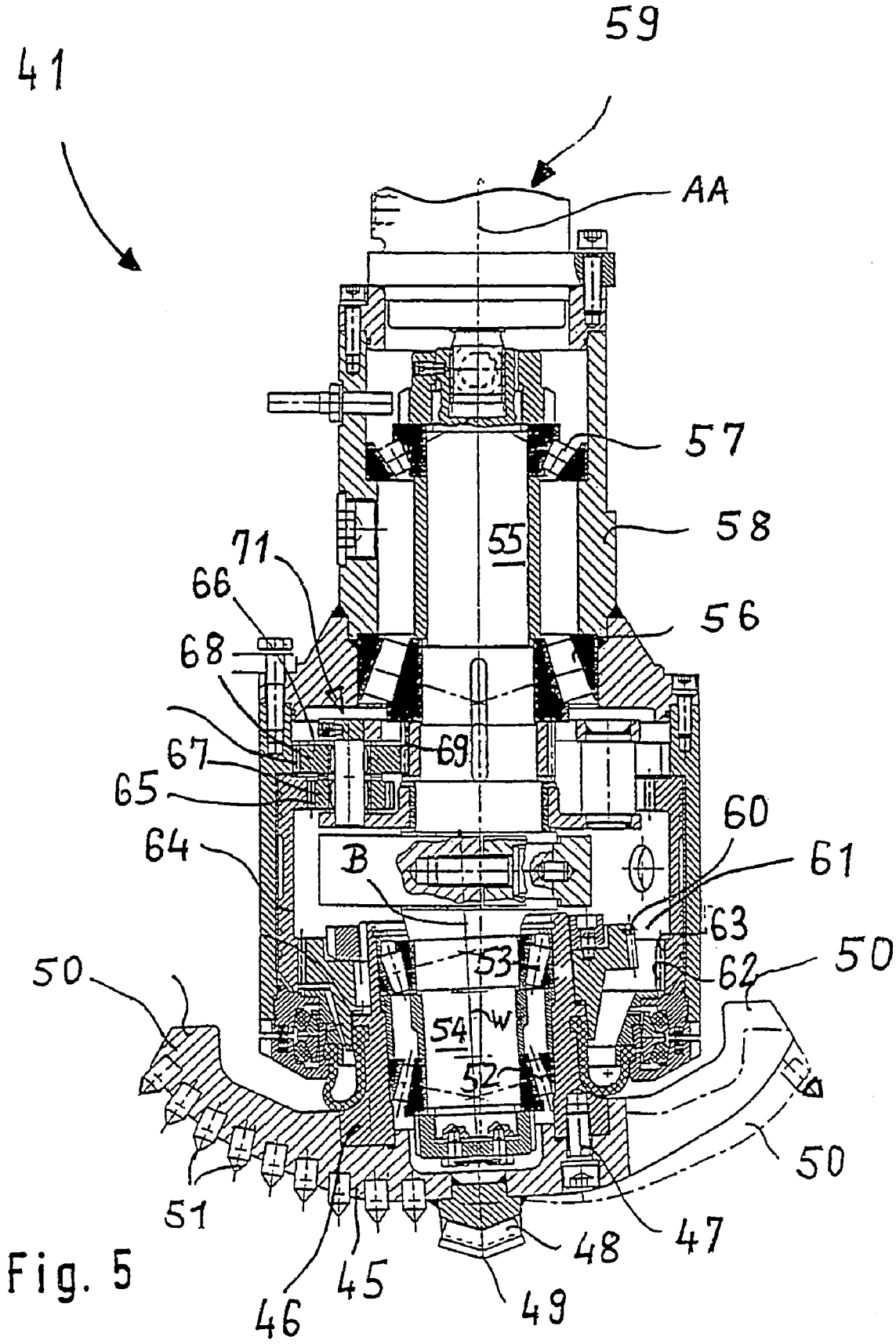
FIG. 5 shows the construction of one of the tools in longitudinal section.

FIG. 5 shows a tool 41 in a detailed illustration. It comprises a head 46 which carries the excavation disk 45. The excavation disk 45 is fixed to the head 46 by a plurality of cylindrical-head bolts 47, of which only one is illustrated in the drawing.

The excavation disk 45 is provided with a central cutter 48. The excavation disk 45 in the exemplary embodiment demonstrated has three arms 50 which extend radially outward and which, as can be seen in the case of the arm illustrated on the left in the drawing, are filled with a plurality of chisels 51.

The head 46 is rotatably mounted by means of tapered roller bearings 52, 53 on a shaft journal 54 of a main shaft 55. The shaft journal 54, having a substantially cylindrical outer circumferential surface, is integrally molded on the main shaft 55 in such a way that its axis B forms an acute angle w of about 3° with the axis of rotation AA.

The main shaft 55 is in turn mounted by means of tapered roller bearings 56, 57 in a machine housing 58 such that it can rotate about the axis of rotation AA and is driven in rotation by a hydraulic motor 59 flange-mounted at the end.

The part of the head 46 facing away from the excavation disk 45 is formed as a gear wheel, called the oscillating gear 60 in the following text, arranged concentrically with the axis B of the shaft journal 54, and therefore formed as a circumferential region 61 which, during rotation of the main shaft 55, runs in internal toothing 63 acting as an opposing circumferential region 62.

The internal toothing 63 is formed on a hollow gear 64 arranged concentrically with respect to the main shaft axis and mounted such that it can rotate with respect to the latter.

At the end opposite to the internal toothing 63, the hollow gear has further internal toothing 65, which is part of an epicyclic gear mechanism designated overall by 71. The toothing of the parts of smaller diameter 67 of the planet gears 66 engages in the internal toothing 65. The parts 68 of larger diameter of the planet gears 66 engage with their toothing in external toothing 69 provided on the main shaft 55 and also in internal toothing 70 provided in the machine housing 58, so that, during the rotary drive of the main shaft 55, the planet gears circulate around the axis of rotation AA in the same direction of rotation. Here, the hollow gear 64 is set rotating in the direction opposite to the excavation disk 45, whose rotation is moved as a result of the oscillating gear 60 running on the internal toothing 63. It goes without saying that, by selecting the ratios in the epicyclic gear mechanism 71, the rotational speed of the hollow gear 64 relative to the main shaft 55 and thus, as a result, the ratio of oscillation frequency to rotational frequency of the excavation disk 45 can be predefined.

Figure 6:
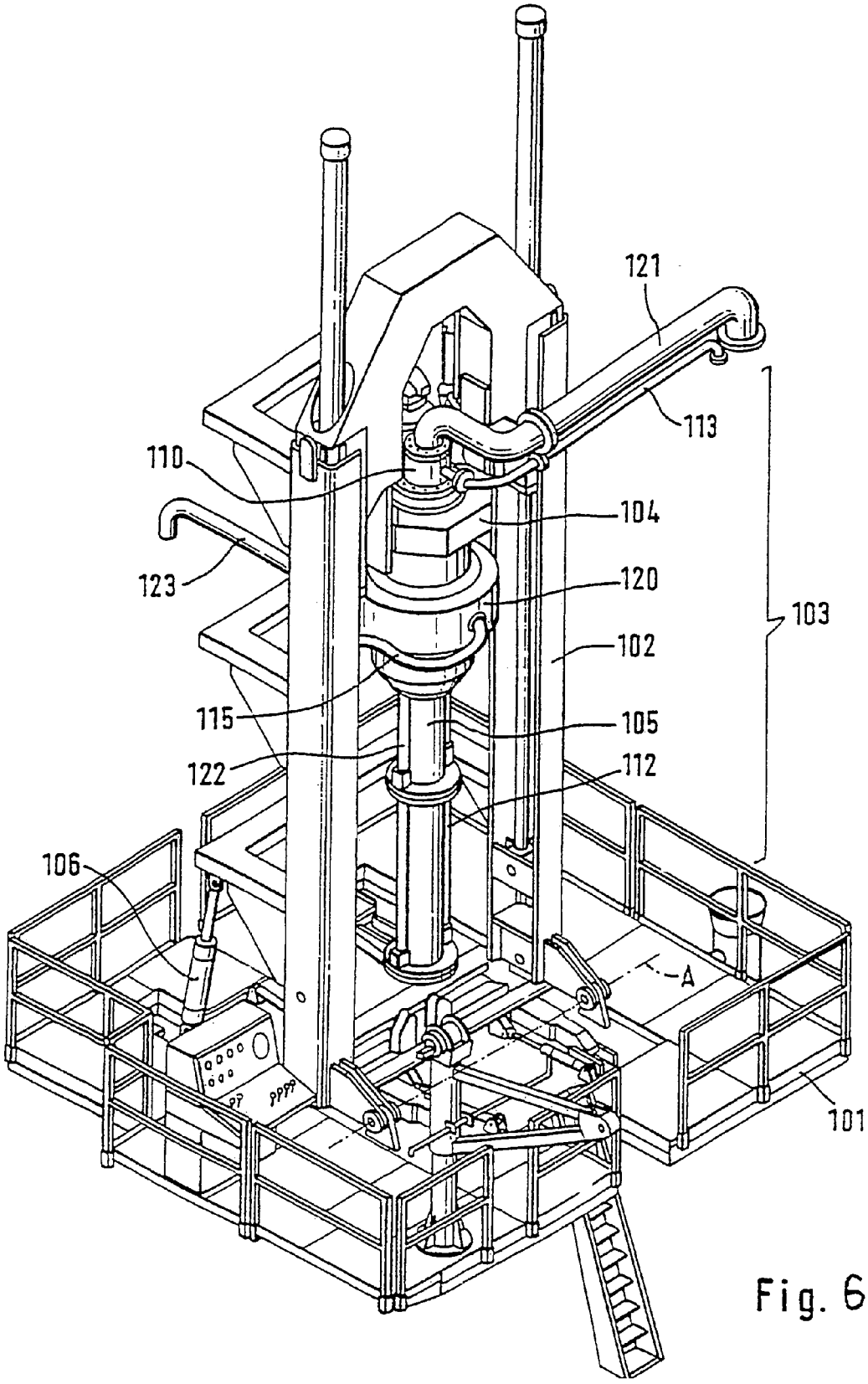
FIG. 6 shows, in perspective form, a view corresponding to FIG. 1 of a second embodiment of the drive system of a device according to the invention.

FIG. 6 shows a second embodiment of a drive device. Mutually functionally corresponding parts are provided with designations increased by 100. The basic structure largely corresponds to that of FIG. 1. To this extent, the description there also applies to the present embodiment.

The drive system of the device, designated overall by 103, is fixed to a supporting device 102 which is supported on a working platform designated overall by 101. A rotary drive head 104, shown schematically, acts on a connecting rod assembly 105 which extends through the working platform 101 into the bore to be drilled in the ground and as far as the tool. The drive of the connecting rod assembly 105 by means of the rotary drive head 104 can be carried out in a conventional manner known from the prior art.

Arranged at the upper end of the connecting rod assembly 105 is a first connecting head, designated by 110, via which material loosened at the base of the bore in the ground is carried away outward via the outlet pipe 121, and a flushing fluid, normally air, is introduced into the connecting rod assembly 105 by means of a first feed line 113. Arranged underneath the first connecting head 110 is a second connecting head, designated overall by 120. The supporting device 102 can be inclined about a horizontal axis A by means of a swiveling drive 106, so that it is also possible for bores in the ground to be drilled in a manner deviating from the vertical.

In the second embodiment of the drive device, the second connecting head 120 can rotate as a whole with the connecting rod assembly 105, and only the first rotary connecting head 110 is mounted so as to be stationary. The rotary drive 104 is designed in such a way that it rotates the connecting rod assembly 105 having the second connecting head 120 for the drive medium of the hammers in the tool to and fro in an oscillatory manner through a predetermined angle about the axis of rotation of the assembly 105. This swept angle is less than 360° and is chosen on the basis of the number and position of the tools 41 located on the same radius. In the case of only one tool 41 per radius, 360° are needed, in the case of two tools offset by 180° from each other per radius, a to and fro rotation of 180° suffices. However, it is likewise within the scope of the invention to rotate the tool head to and fro through an angle which is limited but greater than 360°.

As a result of the limited rotational angle, it is possible to operate a fixedly installed feed line for the drive medium that also participates in the rotational angle, without requiring a rotary seal or wiping contact arrangement. In the exemplary embodiment shown, the drive medium is introduced into the second feed 122 of the connecting rod assembly 105 by means of a flexible hose 115. The hose 115 is mounted between the second feed line 123 and the second feed 122. The length of the hose 115 is chosen such that the hose 115 can follow the rotation of the connecting rod assembly 105 without hindering the latter.

Figure 7:
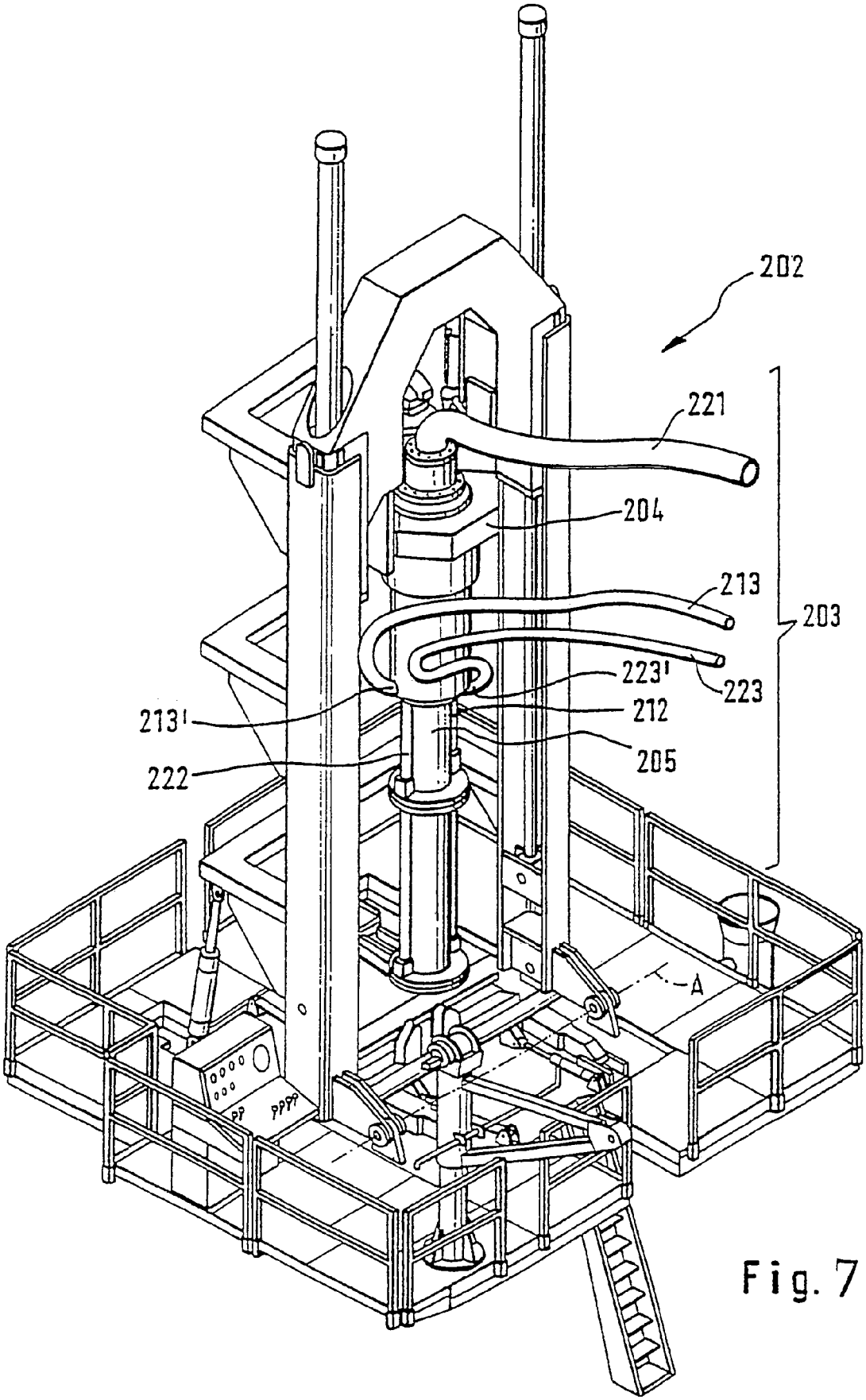
FIGS. 7 and 8 show two further embodiments of the drive system in a view corresponding to FIG. 6.

In a further embodiment, illustrated in FIG. 7, in which mutually functionally corresponding parts are provided with designations increased by 200 with respect to FIG. 1, the feed line 223 for the operating medium, the feed line 213 for the compressed air and the outlet pipe 221 are formed as flexible hoses. The two feed line pipes 213 and 223 are connected under the rotary drive 204, at the points 213', 223', via flange arrangements not illustrated in detail, to the lines 212, 222 running on the connecting rod assembly 205, through which the compressed air is fed to the inlet opening (43 in FIG. 2) and the operating medium to the tool head (40 in FIG. 2). The advantage of this embodiment is that the rotary drive head 204, which, however, in this case effects only an oscillatory movement, merely has to comprise a rotary mounting for the connecting rod assembly 205 but it is possible to dispense entirely with rotary leadthroughs and rotary seals.

In this connection, it should be pointed out that it is not absolutely necessary to connect the flexible hoses 213, 223 to the lines 212, 222 at the points 213' and 223'. Instead, it is likewise possible to dispense entirely with the rigid lines 212, 222 and to lead the hoses 213, 223 as far as the corresponding connecting points, located in the bore, on the connecting rod assembly and, respectively, on the tool head. Furthermore, it is obvious that, depending on the operation of the tools 41, flexible electric cables could also be used instead of the flexible lines.

Instead of the rotary drive head 204 always acting on the upper end of the upper segment of the connecting rod assembly 205, in this embodiment it is also possible to provide a rotary drive 4' which acts on the connecting rod assembly 205 on the outside and whose mode of action and function also otherwise corresponds to that of the rotary drive 4' but which effects only a to and fro movement of the connecting rod assembly.

Figure 8:
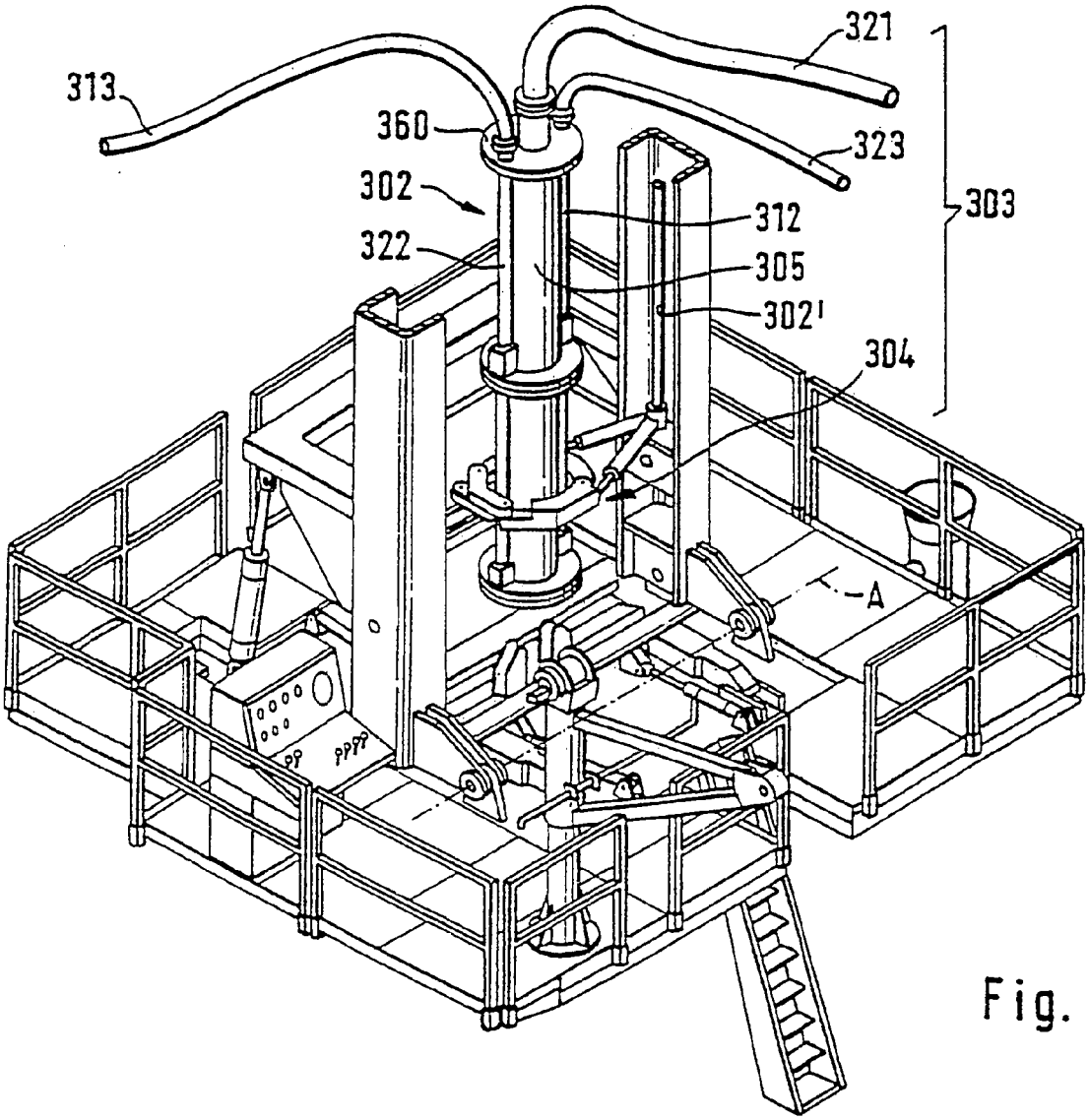

A further embodiment of the device according to the invention is illustrated in FIG. 8. Mutually functionally corresponding elements are provided with designations increased by 300 relative to the embodiments in FIG. 1. In the case of this embodiment, an upper mounting in the context of the rotary drive 204 in FIG. 7 or a rotary connecting head have been dispensed with completely. A drive unit 304, which in terms of its function corresponds to that illustrated in FIG. 9 and is yet to be described further below, is used for the oscillatory drive.

The hose lines 313, 323 are connected to the feeds 312, 322 and the hose line 321 is connected to the interior of the connecting rod assembly 305 with the aid of a flange head 360 which is arranged at the upper end of the upper segment of the connection rod and is constructed in such a way that connections provided on the latter for the hose lines 313, 323, 321 communicate with the lines 312, 322 and the interior of the connecting rod assembly.

The drive unit 304 is mounted on the supporting unit 302 via adjustable-length force generators 302', such that the forward drive force can also be introduced into the connecting rod assembly via the drive unit 304 by lowering the drive unit 304. Once the drive unit 304 has reached its lower position, further forward drive can be effected by "re-gripping", by being released and fixed again after it has been displaced into a higher position with the aid of the force generator, and the procedure begins again. Since, in this device, no supporting unit whose length corresponds at least to that of one segment of the connecting rod assembly 5 is necessary, this embodiment is distinguished by a particularly low overall height.

Figure 9:
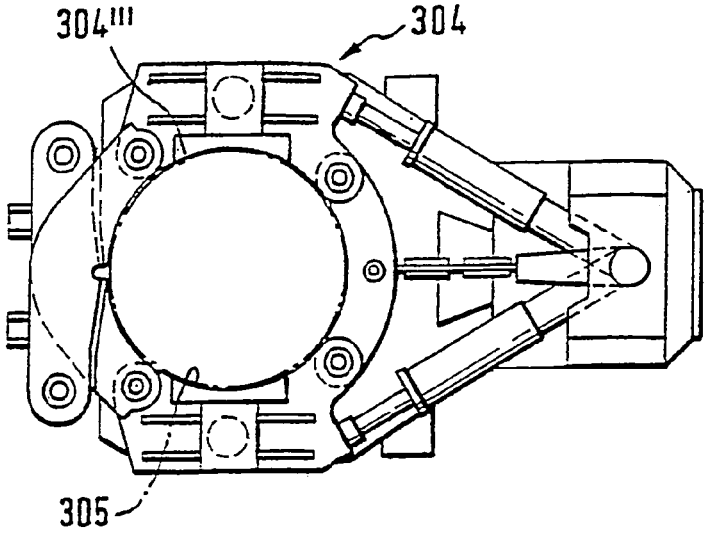
FIG. 9 shows an oscillating drive, such as can be used in the embodiment according to FIG. 8.

The rotary drive 304' illustrated in FIG. 9, which is known per se from piping machines and therefore is not to be described in detail, comprises a part 304''' which can be set into an oscillatory movement with the aid of two piston/cylinder units and which is configured such that it can be folded up in many parts over its circumference. In order to connect it to the connecting rod assembly 305, the part 304''' pushed onto the latter is closed, so that it is operatively connected to the circumferential surface of the connecting rod assembly 205.

Figure 10:
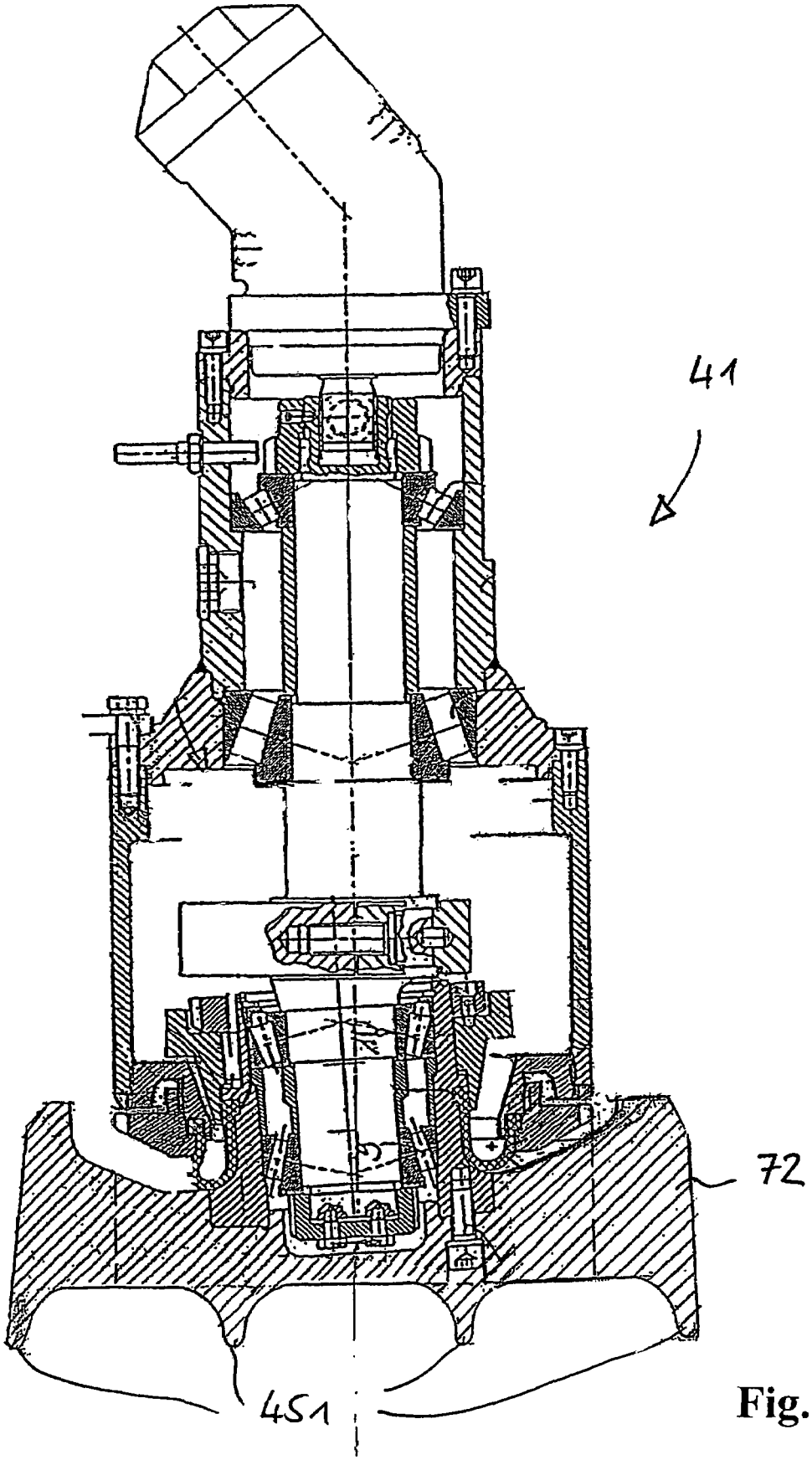
FIG. 10 shows the construction of a further embodiment of a tool in an illustration corresponding to FIG. 5.

A further embodiment of one of the tools 41 is illustrated in FIG. 10. In this tool, the carrier device for the removal means, implemented as a double arm 72, executes only an oscillatory movement but no rotational movement. The mechanical construction of this tool is therefore simplified substantially as compared with that according to FIG. 5, since it is possible to dispense with an opposing circumferential surface on which the circumferential surface runs in order to produce the rotation, and therefore with the entire gear mechanism.

In addition, it is possible to dispense with individual drives for producing the oscillatory movement in each tool and, instead, to provide a central drive which is coupled to the tools. The central drive can contain a gear mechanism having drive shafts for each tool, in order in this way also to be able to vary oscillation frequencies.

Figure 11:
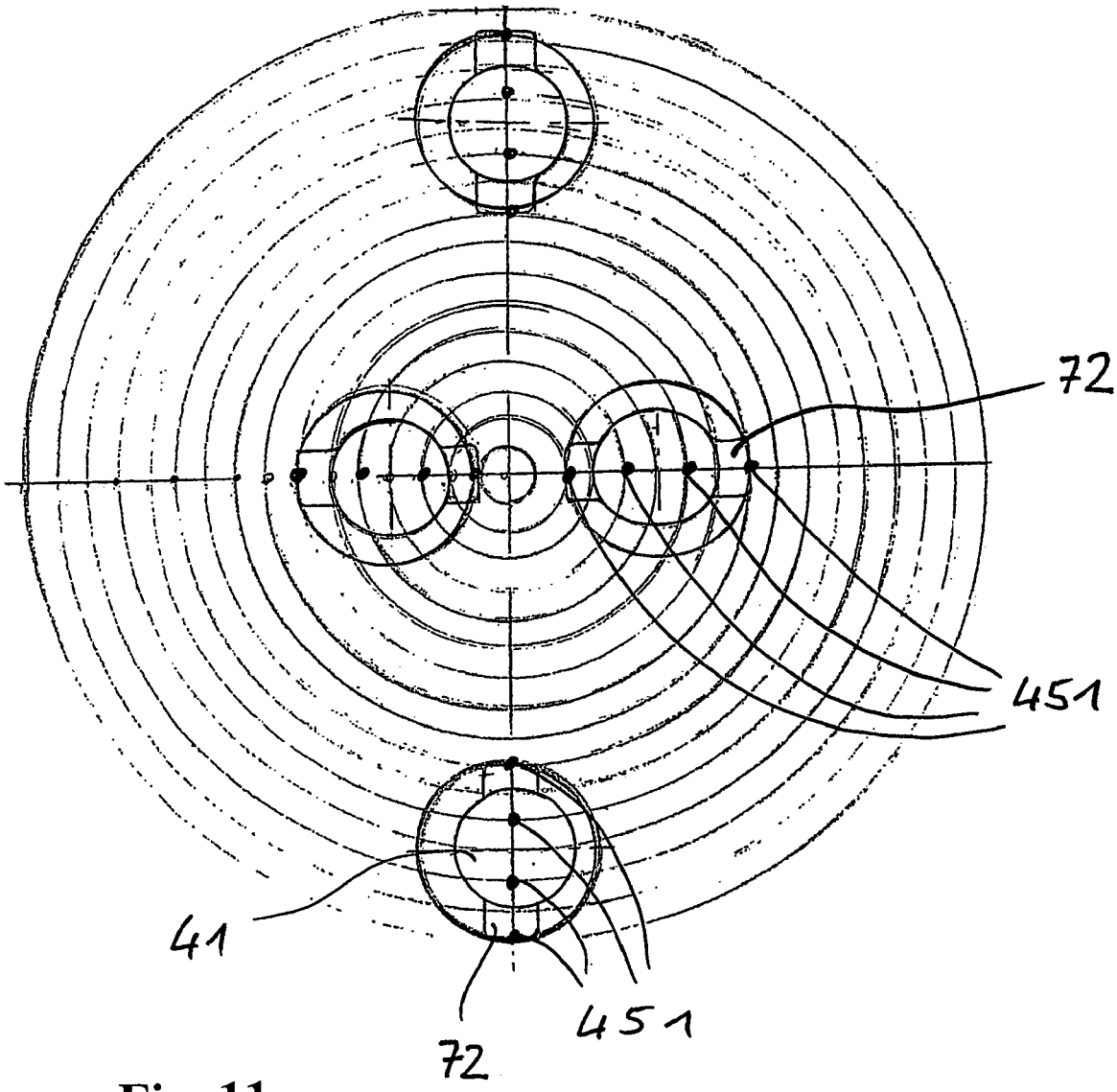
FIG. 11 shows, in schematic form, a preferred arrangement of tools according to FIG. 10 on a tool head.

The tools according to FIG. 10 are arranged in the tool head in such a way that their double arms 72 extend at right angles to the tangents to the circles or circular sections which they sweep over on account of the rotation of the tool head. In addition, as illustrated schematically in FIG. 11, they are arranged to be offset laterally, so that individual cutting tools 451 operate in different tracks.

In this way, as compared with arrangements in which the excavation disks of the tools rotate and/or a plurality of cutting tools operate in one track, a coarser drilled material is obtained. The energy balance is more beneficial on account of the coarser drilled material, since the proportion of energy required for further comminution is dispensed with.

In the above text, only exemplary embodiment of devices according to the invention which are suitable for driving forward bores running substantially vertically have been shown. It goes without saying that the invention is not restricted to such bores but is also suitable for driving forward tunnel bores which run substantially in the horizontal direction.

The invention claimed is:

1. A device for drilling a bore in the ground, comprising a drive system (3) which is connected to a tool head (40), and comprising a plurality of tools (41) which are arranged on the tool head (40) and operate against the face or the base, wherein at least one of the tools (41) comprises a carrier device for removal means, and means which set the carrier device oscillating in operation, wherein the carrier device is a double arm (72) and the arms are arranged so as to extend at right angles to tangents to circles or circular sections which the arms sweep over due to rotation of the tool head.

2. The device as claimed in claim 1, wherein, in order to connect the drive system (3) to the tool head (40), a connecting rod assembly (5) is provided, which extends from the drive system (3) into the bore in the ground and carries the tool head at its end facing the face or the base.

3. The device as claimed in claim 1, wherein at least one drive device (4, 4', 104, 204, 304) is provided, by means of which the tool head (40) can be set rotating about the bore longitudinal axis A.

4. The device as claimed in claim 3, wherein the drive device (4, 4', 104, 204, 304) is configured in such a way that the rotation takes place in a fixed direction.

5. The device as claimed in claim 3, wherein the drive (4, 4', 104, 204, 304) is configured in such a way that the rotation takes place in alternating directions of rotation.

6. A device for drilling a bore in the ground, comprising a drive system (3) which is connected to a tool head (40), and comprising a plurality of tools (41) which are arranged on the tool head (40) and operate against the face or the base, wherein each tool (41) comprises an excavation disk (45) and means which set the excavation disk (45) oscillating in operation, and further comprising means which, in operation, set a carrier device for each tool (41) rotating, wherein each tool comprises a rotationally driven main shaft (55) which has a shaft journal (54) whose axis (B) forms a acute angle (w) with the axis (AA) of the main shaft (55), and a head (46) which mounted such that it could rotate about the axis (B) of the shaft journal (54) and has a circumferential region (61) which runs on an opposite circumferential region (62), and the opposing circumferential region (62) can be set rotating.

7. The device as claimed in claim 6, wherein, in order to connect the drive system (3) to the tool head (40), a connecting rod assembly (5) is provided, which extends from the drive system (3) into the bore in the ground and carries the tool head at its end facing the face or the base.

8. The device as claimed in claim 6, wherein the carrier device comprises an arm or an excavation disk (45).

9. The device as claimed in claim 6, wherein at least one drive device (4, 4', 104, 204, 304) is provided, by means of which the tool head (40) can be set rotating about the bore longitudinal axis A.

10. The device as claimed in claim 9, wherein the drive device (4, 4', 104, 204, 304) is configured in such a way that the rotation takes place in a fixed direction.

11. The device as claimed in claim 9, wherein the drive (4, 4', 104, 204, 304) is configured in such a way that the rotation takes place in alternating directions of rotation.

12. The device as claimed in claim 6, wherein the means are configured in such a way that the rotational frequency is lower than the oscillation frequency.

13. The device as claimed in claim 12, wherein the ratio between rotational frequency and oscillation frequency is 1:30 to 1:60.

14. The device as claimed in claim 6, wherein the circumferential region (61) has external toothing and the opposing circumferential region (62) has internal toothing.

15. The device as claimed in claim 6, wherein the opposing circumferential region (62) is formed by a hollow gear (64) which is arranged concentrically with respect to the axis (AA) of the main shaft (55).

16. The device as claimed in claim 6, wherein the opposing circumferential region (62) can be set rotating by means of an epicyclic gear mechanism (71) which is in engagement with the main shaft (55).

17. The device as claimed in claim 6, wherein the opposing circumferential region (62) can be set rotating by means of a separate drive of the main shaft (55).

18. The device as claimed in claim 17, wherein the separate drive can be controlled or regulated.

* * * * *